United States Patent [19]

Darmara

[11] Patent Number: 4,593,746

[45] Date of Patent: Jun. 10, 1986

[54] METHOD AND APPARATUS FOR PRODUCING SOUND CASTINGS

[76] Inventor: Falih Darmara, Apt. 1 - Bloc C, Parc Guillemo, Andorra La Vella Principat d'Andorra, France

[21] Appl. No.: 598,695

[22] Filed: Apr. 10, 1984

[51] Int. Cl.[4] ..... B22D 27/02

[52] U.S. Cl. ..... 164/495; 164/514

[58] Field of Search ..... 164/114, 495, 514, 272, 164/116, 118, 469; 373/62, 63, 64

[56] References Cited

U.S. PATENT DOCUMENTS

| | | | |
|---|---|---|---|
| 1,833,347 | 11/1931 | Avis . | |
| 2,116,218 | 1/1937 | Seil | 373/64 |
| 3,584,105 | 1/1970 | Pekor | 164/114 |
| 3,920,062 | 11/1975 | Soykan et al. | 164/469 |
| 4,261,412 | 4/1981 | Soykan et al. | 164/469 |

*Primary Examiner*—Nicholas P. Godici
*Assistant Examiner*—G. M. Reid
*Attorney, Agent, or Firm*—Bacon & Thomas

[57] ABSTRACT

A method of producing sound metal castings, particularly of reactive metals, by striking an electrical arc in a gap defined by adjacent end faces of opposed elongate electrodes, wherein the electrodes are mounted for rotation about longitudinal axes that are parallel and offset with respect to each other, realizing substantially complete overlapping of the adjacent end faces during rotation of the electrodes to cause uniform depletion of same, and wherein the metal droplets derived at the gap are maintained in a fully molten condition until they have been cast into an adjacent mold.

10 Claims, 5 Drawing Figures

METHOD AND APPARATUS FOR PRODUCING SOUND CASTINGS

BACKGROUND OF THE INVENTION

1. Field of the Invention

The present invention generally involves the centrifugal casting of molten metal. More specifically, the invention relates to an improvement in the casting of molten metal in a rotating mold wherein the molten metal is derived from an arc gap between a pair of opposing electrodes, at least one of which is formed of the metal to be cast.

2. Description of the Prior Art

It is known to cast metal, particularly the production of fine grain castings from prealloyed metals, wherein the metal to be cast is configured as at least one of a pair of opposing electrodes which, upon the application of electrical energy thereto, strike an arc therebetween to provide the heat necessary for melting the consumable electrode. The molten metal droplets developed at the arc gap are thereafter cast within a rotating mold.

The electrodes are conventionally each of a corresponding cylindrical configuration and supported for rotation relative to each other about a common longitudinal axis. The centrifugal force developed by the rotating mold causes the molten metal received therein to be solidified into the desired casting.

Casting systems of this type have typically been utilized for the production of fine grain castings which are intended for subsequent working so as to impart desired strength and other structural properties to the final product. The presence of a fine crystalline structure greatly facilitates subsequent working of the casting, such as through forging and related mechanical procedures. It is therefore the primary aim of these conventional systems to produce castings wherein the rate of solidification of the molten metal from its origination at the arc gap to its final destination in the mold is as rapid as possible in order to produce the desired fine grain structure.

However, these known systems have been characterized by certain disadvantages. For example, if a casting to be made is large in size, then the electrodes must also be correspondingly large in order to supply the quantity of metal required. However, a serious problem has heretofore existed in the fabrication and alignment of the electrodes in order to realize their uniform depletion during the casting process. Typically, large electrodes are of cylindrical configuration and formed by casting from the desired metal. It is difficult to cast a large electrode which is not out of round or bent. While these deformities can be corrected through machining, this correction procedure is costly and results in an undesirable amount of scrap metal. Since a stub must be welded to the electrode in order to conduct the current thereto, any welding inaccuracy also compounds the deformity problem, thereby rendering the alignment of the electrodes a very difficult problem to solve. If the longitudinal center lines of the electrodes are located by reference to the attachment surface of the stub, the ends of the electrodes will wobble when the electrodes are rotated. If the longitudinal center lines are located by reference to the electrode surfaces, the ends of the stubs will wobble. Because conventional electrode systems align the electrodes on the same longitudinal center line, the resulting wobble of the electrodes cause their nonuniform depletion, even if the electrodes are isolated relative to each other. Though these systems are generally capable of producing fine grain castings, it is this alignment problem which also precludes the production of a sound casting having a uniform structure throughout the casting. When the casting is large and the molten metal droplets have a large distance to travel from the electrode edge to the casting surface of the mold, this causes the metal droplets to accumulate and solidify in the mold in clustered form, thus resulting in an unsound cast product. This is because the droplets leaving the electrode are at their melting point and very little heat has to be extracted to cause rapid solidification.

SUMMARY OF THE INVENTION

It is an object of the present invention to provide an improved method of centrifugal casting through which sound metal castings having a uniform structure are produced.

It is another object of the invention to provide an improved method of centrifugal casting utilizing at least one consumable electrode of the metal being cast wherein uniform depletion of the consumable electrode is realized.

The foregoing and other objects of the invention are achieved by providing a method of casting wherein at least one of the pair of opposing electrodes serving to define an arc gap therebetween is made of the metal to be cast. The electrodes are each welded to the end of a corresponding stub supported in a fixture which serves to both accurately locate the longitudinal positioning of the stub and permit it to be rotated. The longitudinal axes of the stubs are eccentric to each other by an amount sufficient to compensate for the wobble of the electrode pieces relative to each other due to casting deformities or inaccuracies in the welding of electrodes to their corresponding stubs. When an arc is struck between the electrodes and the latter are rotated in the same direction, but at different rates, over a given period of time, the corresponding faces of the electrodes defining the arc gap shall be evenly exposed to each other and thereby cause a uniform depletion of the electrodes. It is further possible to achieve uniform depletion of the electrodes in this manner by rotating the electrodes in opposite directions at any desired rate. A circular mold is disposed around the arc gap and positioned so that the arc gap is as close as possible to the bottom face of the mold, thus permitting the droplets of molten metal to reach the mold casting surface as quickly and at as high a temperature as possible. The circular mold is rotated so that the centrifugal force generated thereby causes the molten metal droplets to be uniformly deposited and accumulated in layers therein and solidified to form the cast product. The position of the arc gap is longitudinally reciprocated by shifting the electrodes together through the use of hydraulic rams in order to provide a uniform deposition of molten metal in the mold. Sufficient current is applied to the electrodes in order to maintain the molten droplets in a molten state until they have been deposited and smoothly layered within the mold, thereby resulting in a sound casting that is structurally homogeneous and built up from layers of molten metal.

Other objects, features and advantages of the invention shall become apparent from the following detailed description of preferred embodiments thereof, with reference to the accompanying drawings which form a part of the specification, wherein like reference characters designate corresponding parts of the several views.

DETAILED DESCRIPTION OF THE PREFERRED EMBODIMENTS

Figure 1:
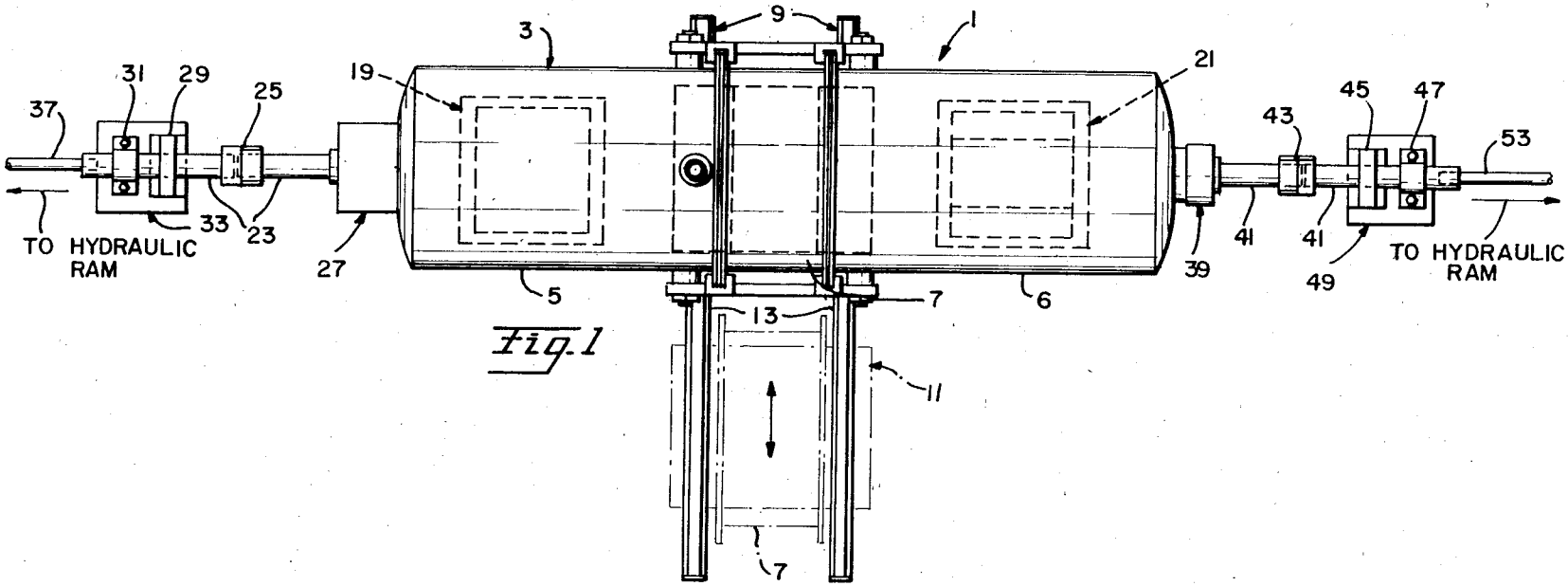
FIG. 1 is a plan view of an apparatus used to practice a preferred embodiment of the present invention, shown with a car being used to support a movable section of the vacuum chamber being displaced to a position wherein the movable section normally supported thereon would be detached from the vacuum chamber for the purpose of gaining access to the interior thereof.
Figure 2:
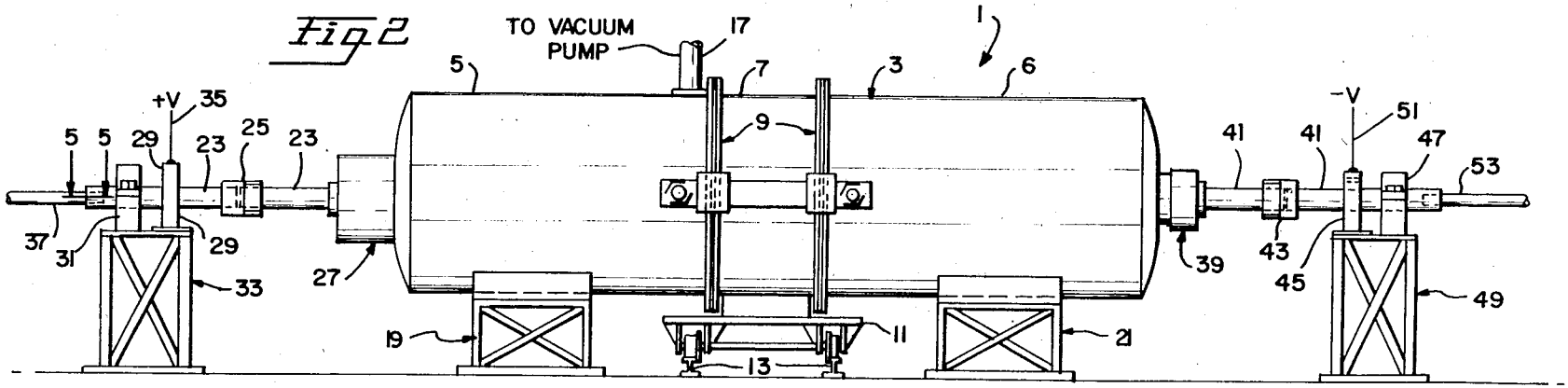
FIG. 2 is a side elevational view of the apparatus of FIG. 1.

An apparatus 1 for the practice of the present invention according to a preferred embodiment thereof shall now be described with reference to FIGS. 1 and 2. Apparatus 1 includes a vacuum chamber 3 comprised of a pair of opposed stationary sections 5 and 6 and a movable section 7 disposed therebetween and detachably secured thereto through a pair of flanged seal assembies 9. Each seal assembly 9 may be of any conventional type well known in the art and deemed suitable for the practice of the invention as described herein.

Movable section 7 is supported on a car 11 which in turn is supported for lateral movement on a pair of rails 13. This arrangement permits movable section 7 to be laterally displaced away from stationary sections 5 and 6 upon disconnection of seal assemblies 9, as schematically depicted in the two positions of car 11 shown in FIG. 1.

Chamber 3 is also provided with an outlet 17 for connection to a vacuum pump (not shown) for the purpose of evacuating the interior of chamber 3. As shown in FIG. 2, stationary sections 5 and 6 are rigidly secured in position by a pair of support frames 19 and 21, the structural configurations of which may be of any type that is conventionally known in the art for this purpose.

Stationary section 5 is provided with an electrode shaft 23 that is preferably sectioned and secured together through a disconnect coupling 25. One end of shaft 23 extends longitudinally into stationary section 5 and is supported for rotation through a bearing seal assembly 27. The other end of shaft 23 is supported for rotation through a commutator 29 in a support bearing 31, both of which are in turn carried by a support frame 33. Commutator 29 is provided with an electrical connection line 35 for receiving current from an appropriate source (not shown). The terminal end of shaft 23 extends outwardly from support bearing 31 and is attached to a ram shaft 37 forming a part of a hydraulic ram (not shown) for imparting longitudinal movement to the shaft 23 with respect to section 5.

Likewise, stationary section 6 is also provided with a corresponding bearing seal assembly 39 for rotatably supporting an electrode shaft 41, the latter being preferably sectioned and secured together by a disconnect coupling 43. Shaft 41 extends longitudinally into the interior of section 6 and is further provided with an exterior end that is supported for rotation by a commutator 45 and a support bearing 47, both of which are in turn carried by a support frame 49. Commutator 45 is provided with an electrical connection line 51 for receiving current from an appropriate source (not shown). The terminal end of shaft 41 extending outwardly from support bearing 47 is attached to a ram shaft 53 forming a part of a hydraulic ram (not shown) for imparting longitudinal movement to shaft 41 with respect to section 6.

Figure 3:
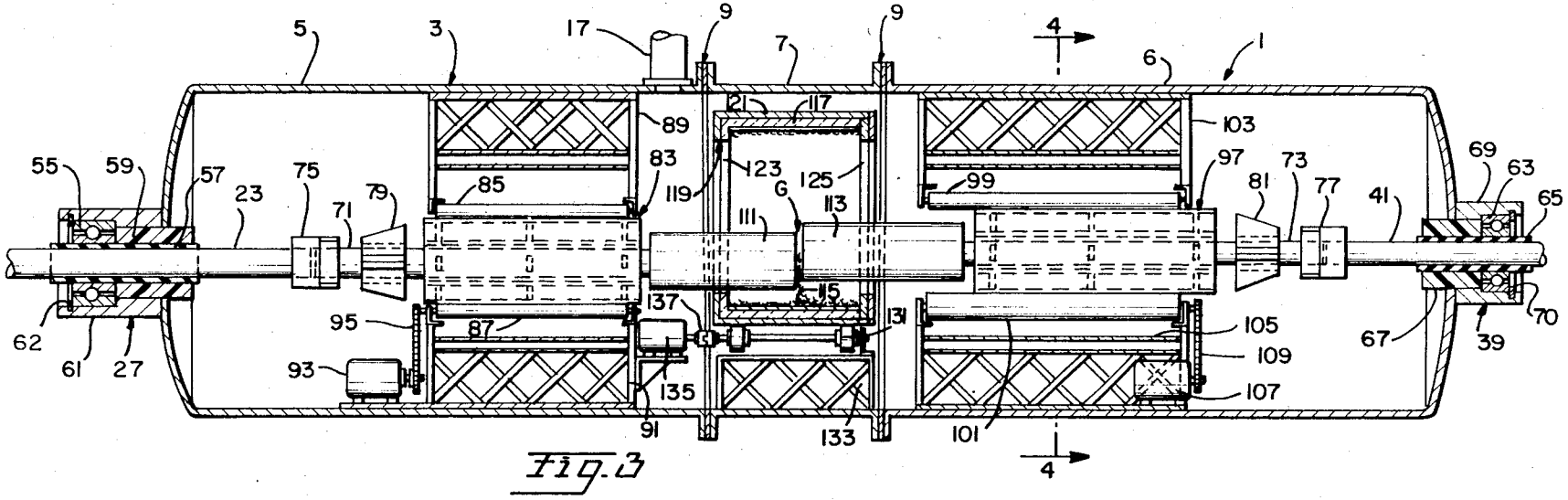
FIG. 3 is an enlarged vertical sectional view taken through the apparatus of FIG. 1.

The internal details of chamber 3 shall now be described with reference to FIG. 3. As shown therein, bearing seal assembly 27 includes a ball bearing assembly 55, an inner electrical insulating sleeve 57 and an outer support sleeve 59, all of which are disposed within and secured to an external casing 61 by ring clip 62. Assembly 27 functions to support electrode shaft 23 for both rotary and longitudinal movements with respect to stationary section 5, and also provide a vacuum seal to permit evacuation of chamber 3.

Similarly, bearing seal assembly 39 associated with stationary section 6 is also provided with a corresponding ball bearing assembly 63, an inner electrical insulating sleeve 65 and an outer support sleeve 67, all of which are secured within an external casing 69 by a ring clip 70. Electrode shaft 41 is also supported for both rotary and longitudinal movements with respect to stationary section 6 by assembly 39, the latter further serving to provide an appropriate vacuum seal for chamber 3.

Electrode shafts 23 and 41 are each secured at their internal ends within chamber 3 to a pair of stub shafts 71 and 73, respectively. Shafts 23 and 71 are connected by a disconnect coupling 75, and a similar disconnect coupling 77 is provided for connecting shafts 41 and 73. Stub shafts 71 and 73 are also preferably provided with a pair of stop clamps 79 and 81, respectively, for the purpose of limiting their longitudinal movement within chamber 3.

Stub shaft 71 is carried within a stub cage 83 which is in turn supported for rotation by a plurality of opposed idler rollers 85 and driven rollers 87. Rollers 85 and 87 are supported by an upper roller cage 89 and a lower roller cage 91, respectively. Rollers 87 are driven by a motor 93 through a chain drive 95 for the purpose of imparting rotation to stub cage 83. Likewise, stub shaft 73 is carried within a stub cage 97 which is supported for rotation between a plurality of idler rollers 99 and driven rollers 101. Rollers 99 and 101 are supported by an upper roller cage 103 and a lower roller cage 105, respectively. Rollers 101 are driven by a motor 107 through a chain drive 109.

The internal end of stub shaft 71 is provided with an electrode 111 and the internal end of stub shaft 73 is also provided with a corresponding opposed electrode 113. Electrodes 111 and 113 are preferably of cylindrical configuration and secured to the ends of their corresponding stub shafts 71 and 73 in any manner well known in the art, such as through welding. It is preferable that at least one of electrodes 111 and 113 be made of the metal desired to be cast, and thus consumable during the practice of the invention. The remaining electrode is preferably of the same metal, but may also be of nonconsumable material. It is important to note from FIG. 3 that the longitudinal axes of rotation of stub shafts 71 and 73 are not coaxial, but are instead offset with respect to each other, with the longitudinal axis of each electrode being coaxial with the longitudinal axis of its corresponding stub. This configuration assures a uniform moment of rotation for each electrode. It is preferable that the amount of offset between the longitudinal axes of each electrode be at least four inches. As evident in FIG. 3, an arc gap G is defined by the spacing between the offset corresponding faces of electrodes 111 and 113. This offset has been found to provide a uniform depletion of the at least one consumable electrode or, in the case of both electrodes being consumable, uniform depletion of both electrodes when an arc is struck between electrodes 111 and 113. It has also been found that the eccentric dispositions of electrodes 111 and 113 serve to eliminate the effects of end wobble, an undesirable characteristic normally associated with known electrode systems of this type.

When sufficient current is provided electrodes 111 and 113, an arc is struck at gap G, thereby providing intense heat for melting the at least one consumable electrode. As the electrode is consumed during this process, a plurality of molten metal droplets 115 are developed and dropped downwardly to contact a casting surface 117 of a circular mold 119. It should further be noted that the electrodes are disposed very close to casting surface 117 of mold 119. Casting surface 117 is preferably formed of high temperature resistant refractory material, lined with a very thin sheet of metal of the appropriate composition to prevent sticking of the metal droplets to the refractory and facilitate the extraction of the finished casting. This assembly is encased within an outer metal shell 121. Mold 119 is of circular configuration and provided with opposed openings 123 and 125 for receiving electrodes 111 and 113 therein. A plurality of lower driven rollers 131 carried by a lower roller cage 113 support mold 119 for rotation about an axis that is preferably not coaxial with the common axis of rotation of stub shafts 71 and 73. Rollers 131 are driven by a motor 135 through an appropriate drive shaft 137.

Figure 5:
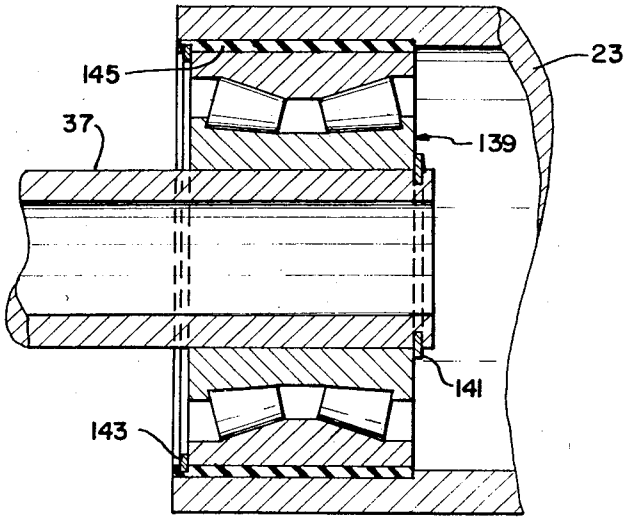
FIG. 5 is an enlarged fragmentary vertical sectional view, taken on the line 5—5 of FIG. 2, showing details of the coupling between the electrode shaft and hydraulic ram shaft.

The details of the connection between ram shaft 37 and electrode shaft 23 shall now be described with reference to FIG. 5. It is understood that this connection configuration is exactly the same for ram shaft 53 and its corresponding electrode shaft 41, and therefore applies equally thereto. The terminal end of ram shaft 37 is secured against longitudinal movement by a tapered rolling bearing assembly 139, the latter being in turn secured in position between ram shaft 37 and electrode shaft 23 by an inner ring clip 141 carried by shaft 37 and an outer ring clip 143 carried by shaft 23. An electrical insulating liner 145 is disposed between bearing assembly 139 and the inner wall of shaft 23. Therefore, movement between shafts 23 and 37 is confined only to the relative rotation of shaft 23 about shaft 37. Because of this configuration, longitudinal movement of shaft 37 through actuation of its associated hydraulic ram causes corresponding longitudinal movement of shaft 23, thereby advancing or retracting electrode 111 relative to electrode 113.

Figure 4:
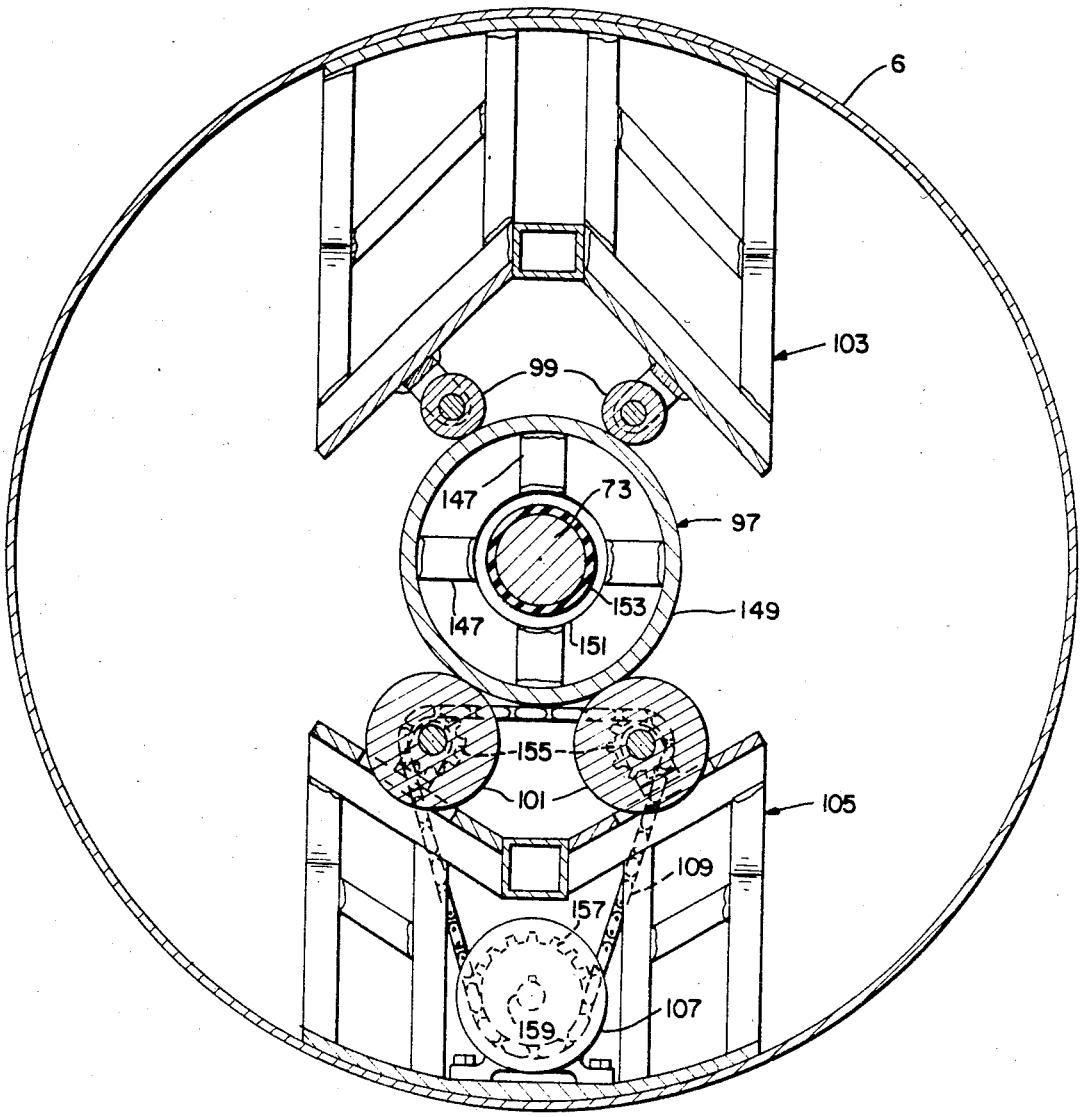
FIG. 4 is an enlarged transverse sectional view taken on the line 4—4 of FIG. 3.

Referring now to FIG. 4, there is shown the details of stub cage 97 and its associated upper and lower roller cages 103 and 105, as disposed within stationary section 6. It is of course understood that the structural details described for FIG. 4 also apply equally for corresponding stub cage 83 and its associated roller cages 89 and 91 disposed in stationary section 5. Stub cage 97 supports stub shaft 73 coaxially therein through a plurality of circumferentially spaced struts 147 which have their opposite ends rigidly secured to the interior wall of a cylindrical shell 149 and the exterior wall of a cylindrical inner sleeve 151. An electrical insulating sleeve 153 is disposed between stub shaft 73 and inner shell 151. It is preferred that plural sets of struts 147 be longitudinally spaced along the annular space defined by outer and inner shells 149 and 151. The fit between inner shell 151 and insulating sleeve 153 is sufficiently loose so that stub shaft 73 can be removed for repairs and replacement, and also to facilitate welding of shaft 73 to its corresponding electrode 113. An appropriate clamping or locking device (not shown), such as a key, may be provided to attach inner shell 151 to sleeve 153, and the latter to stub shaft 73. Such device shall serve to insure that rotary movement imparted to cylindrical shell 149 is transmitted directly and continuously to stub shaft 73.

As previously described, stub cage 97 is supported for rotation between upper idler rollers 99 and lower driven rollers 101, the driving of the latter rollers being accomplished through electric motor 107 and chain drive 109. The connection between chain drive 109 and rollers 101 is achieved by a pair of sprockets 155, and the connection between chain drive 109 and motor 107 is achieved through a sprocket 157 carried by a drive shaft 159 of motor 107. Idler rollers 99 are carried by a roller cage 103 which is in turn rigidly secured to the upper interior wall of stationary section 6. Driven rollers 101 are carried by roller cage 105 which is in turn rigidly secured to the opposing lower interior wall of stationary section 6.

MODE OF OPERATION

A preferred mode of practicing the present invention shall now be described with general reference to the drawings, and with particular reference to FIG. 3. In the production of a uniform and structurally homogeneous casting in mold 119, it is preferred that both the electrodes 111 and 113 be consumable and formed of the metal to be cast. Since chamber 3 may be evacuated to produce a vacuum therein, the casting of highly reactive metals, such as titanium, niobium and zirconium, can be advantageously conducted in apparatus 1.

Electrodes 111 and 113, formed of the metal to be cast, are attached to their respective stub shafts 71 and 73 supported within corresponding stub cages 83 and 97. Actuation of the hydraulic rams (not shown) serve to dispose electrodes 111 and 113 a desired distance from each other to form an arc gap G defined by the offset eccentric faces of same.

Activation of motors 93 and 107 causes stub cages 83 and 97 to rotate, thereby rotating their associated stub shafts 71 and 73, and electrodes 111 and 113. Electrodes 111 and 113 are preferably rotated in the same direction and at different speeds of rotation. Mold 119 is also caused to rotate by the activation of motor 135.

Electrical current is then supplied to commutators 29 and 45 through their respective electrical connection lines 35 and 51, with such current being of sufficient intensity in order to strike an electric arc at arc gap G and cause the depletion of the electrodes 111 and 113 into molten droplets 115. It is important that sufficient current be applied to electrodes 111 and 113 to assure that molten droplets 115 remain molten until they are in contact with casting surface 117 and form a smooth molten layer thereagainst under centrifugal force prior to solidification. Once the initial layer of molten metal has solidified against casting surface 117, additional molten droplets 115 are crushed against the initial solidified layer of metal due to the centrifugal force, and are incorporated immediately into the body of the accumulating casting. Solidification of molten droplets 115 should not occur until they have been smoothly layered against the casting to become an integral and structurally homogeneous portion thereof.

Arc gap G may be maintained at its optimum melting efficiency by means of any suitable voltage control system well known in the art and deemed appropriate for the practice of the invention as disclosed herein. Such a system can be utilized to control the positioning of the individual electrodes by their hydraulic rams so that when one electrode is manually or automatically positioned, the other electrode will undergo a corresponding positioning in order to maintain a constant arc gap G. In this manner, arc gap G may be positioned back and forth across the mold surface in order to deposit alternate smooth layers of molten metal in mold 119. The rotation of mold 119 should be maintained at sufficient speed so that the resulting centrifugal force causes an immediate and uniform layering of molten droplets 115 across the circumferential interior of mold 119 so that, upon solidification, a ring-shaped casting is produced.

Because of the eccentric mounting of electrodes 111 and 113, the adjacent faces thereof realize full overlapping disposition with respect to each other during rotation. This produces an extremely uniform and even depletion of electrodes 111 and 113 during their consumption. As electrodes 111 and 113 are continuously consumed, their respective hydraulic rams are actuated to move them longitudinally towards each other so as to always maintain an optimum spacing for arc gap G.

An important advantage of the present invention comprises its ability to produce large ring-shaped castings, particularly of such reactive metals as titanium and zirconium, which are extremely uniform and homogeneous in structure. Because of the difficulties realized in the controlled melting of these reactive metals and alloys thereof, conventional procedures and techniques cannot produce castings having the weight and dimensions made possible by the practice of the present invention. For example, a pair of titanium electrodes 20 inches in diameter and 48 inches long would produce a ring-shaped casting weighing about 5000 pounds when melted. When such a casting is produced in a mold 60 inches in diameter and 60 inches long, a casting weighing about 5000 pounds would be approximately 3 inches thick. When such a casting is cut into two equal segments and straightened, this would result in two slab ingots 60 inches wide×94 inches long×3 inches thick, and be in condition for continuous sheet production in a rolling mill. Slab ingots of this nature are impossible to produce by heretofore known techniques and procedures in this field of technology.

It is known that the molten metal produced from consumable electrode melting is at a temperature very close to its melting point unless heated by radiation from the arc. In double electrode melting, the molten metal droplets do not remain in the arc gap to be appreciably heated, hence they are very close to their melting point. This causes them to solidify quickly with resulting fine grain structure. However, this also causes the droplets to solidify if the distance to the mold from the arc gap is more than a few inches. In this latter undesirable situation, the rapid solidification produces a nonuniform casting characterized by an uneven porous structure defined by bunches of metal nodules agglomerated together.

The primary characteristic desired of a casting produced through the practice of the present invention is that it be structurally uniform without the undesirable characteristics associated with rapidly solidified castings. It has been discovered that extremely uniform castings may be produced by applying sufficient current to maintain an ample supply of molten metal droplets while simultaneously disposing the arc gap to within a few inches of the mold, thus not only shortening the time of travel of the molten metal droplets to the mold, but also securing heat transfer, by radiation, from the arc gap to maintain the droplets in a molten form until they have been properly accumulated and layered within the mold prior to the initiation of solidification.

While the invention has been described and illustrated with reference to certain preferred embodiments and operating parameters, it shall be appreciated that various modifications, changes, additions, omissions and substitutions may be resorted to by those skilled in the art and considered to be within the spirit and scope of the invention and appended claims.

I claim:

1. A method of producing large sound metal castings by striking an electrical arc in a gap defined by adjacent end faces of opposed large elongate electrodes, each of which is mounted for rotation about a longitudinal axis and subject to wobble, with at least one electrode being made of the metal to be cast and consumable by the heat of the arc to produce molten metal droplets which fall by gravity into a mold spaced from the gap to form the casting, the improvement comprising:

A. mounting the electrodes with their longitudinal axes parallel and sufficiently offset with respect to each other for realizing substantially complete overlapping of the adjacent end faces during rotation of the electrodes to compensate for electrode wobble and cause uniform depletion of the at least one consumble electrode; and B. maintaining the metal droplets in substantially fully molten condition until they have been cast into the mold.

2. The method of claim 1 further including the step of rotating a ring-shaped mold around the gap for receiving and centrifugally casting the molten metal droplets therein.

3. The method of claim 2 further including the step of disposing the gap in a position offset from the axis of rotation of the mold and adjacent the lowermost portion thereof.

4. The method of claim 1 including the step of rotating the electrodes in the same direction.

5. The method of claim 4 further including the step of rotating the electrodes at different speeds.

6. The method of claim 1 wherein the step of maintaining the metal droplets in substantially fully molten condition includes applying sufficient current to the electrodes so that the resulting molten metal droplets are maintained at a temperature above the solidification temperature of the metal for at least the distance from the gap to the mold.

7. An apparatus for producing large sound metal castings by striking an electrical arc in a gap defined by adjacent end faces of opposed large elongate electrodes, each of which is mounted for rotation about a longitudinal axis and subject to wobble, with at least one electrode being made of metal to be cast and consumable by the heat of the arc to produce molten metal droplets which fall by gravity into a mold spaced from the gap to form the casting, the improvement comprising the electrodes being mounted with their longitudinal axes parallel and sufficiently offset with respect to each other for realizing substantially complete overlapping of the adjacent end faces during rotation of the electrodes to compensate for electrode wobble and cause uniform depletion of the at least one consumable electrode, whereby the metal droplets are maintained in substantially fully molten condition until they have been cast into the mold.

8. The apparatus of claim 7 further including a rotatable ring-shaped mold disposed around the gap for receiving and centrifugally casting the molten metal droplets therein.

9. The apparatus of claim 8 wherein the gap is disposed in a position offset from the axis of rotation of the mold and adjacent the lowermost portion thereof.

10. The apparatus of claim 7 further including a pair of elongate stubs, with each electrode being attached to a corresponding stub and the longitudinal axes of each electrode and its corresponding stub being coaxial.

* * * * *